US007290366B2

(12) United States Patent
Endres

(10) Patent No.: US 7,290,366 B2
(45) Date of Patent: Nov. 6, 2007

(54) BODY MOUNTED WEAPONS PLATFORM

(76) Inventor: Steven J. Endres, 265 N. Oxford Dr., San Angelo, TX (US) 76901

( * ) Notice: Subject to any disclaimer, the term of this patent is extended or adjusted under 35 U.S.C. 154(b) by 442 days.

(21) Appl. No.: 10/945,125

(22) Filed: Sep. 20, 2004

(65) Prior Publication Data

US 2007/0068378 A1 Mar. 29, 2007

(51) Int. Cl.
*F41C 9/00* (2006.01)

(52) U.S. Cl. ..... 42/1.11; 89/37.04; 42/1.09

(58) Field of Classification Search ..... 89/37.04; 42/1.09, 1.11; 2/4, 161.5
See application file for complete search history.

(56) References Cited

U.S. PATENT DOCUMENTS 2,598,143 A * 5/1952 Smith ..... 2/94
2,977,703 A * 4/1961 Sarvis ..... 42/94
3,664,560 A * 5/1972 Perkins ..... 224/677
4,153,927 A * 5/1979 Owens ..... 362/99
4,398,365 A * 8/1983 Pokhis ..... 42/1.11
4,770,327 A * 9/1988 Fortson ..... 224/485
5,014,892 A * 5/1991 Copeland ..... 224/271
5,166,459 A * 11/1992 Stahle ..... 42/71.02
5,347,740 A * 9/1994 Rather et al. ..... 42/94
5,449,103 A * 9/1995 Tilley ..... 224/244
5,491,919 A * 2/1996 Rather et al. ..... 42/94
5,511,703 A * 4/1996 Ryerson ..... 224/682
5,603,441 A * 2/1997 Easter ..... 224/582
5,738,256 A * 4/1998 Goff et al. ..... 224/185
5,824,942 A * 10/1998 Mladjan et al. ..... 89/41.17
5,852,253 A * 12/1998 Baricos et al. ..... 89/1.41
5,991,925 A * 11/1999 Wu ..... 2/102
6,032,397 A 3/2000 Iannetta
6,179,185 B1 * 1/2001 Dancyger ..... 224/576
6,272,781 B1 * 8/2001 Resnick ..... 42/1.11
6,446,852 B1 * 9/2002 Sorensen et al. ..... 224/661
6,556,245 B1 4/2003 Holmberg
6,598,329 B1 * 7/2003 Alexander ..... 42/71.01
6,641,009 B2 * 11/2003 French et al. ..... 224/244
6,694,661 B1 * 2/2004 Langford ..... 42/94
6,760,922 B1 * 7/2004 Morales ..... 2/94
6,951,033 B2 * 10/2005 Dainese ..... 2/69
7,146,899 B2 * 12/2006 Imblum et al. ..... 89/36.01
2003/0094470 A1 * 5/2003 Cragg ..... 224/236

* cited by examiner

*Primary Examiner*—Bret Hayes
(74) *Attorney, Agent, or Firm*—Michael L. Greenberg, Esq.; Greenberg & Lieberman, LLC

(57) ABSTRACT

A body mounted weapons platform is disclosed that attaches to a user's forearm and allows the user to mount within it one or two firearms (depending on the user's preferred embodiment) and two cameras. Both embodiments of the body mounted weapons platform will help improve optical reconnaissance, firearm safety, and targeting skills.

11 Claims, 9 Drawing Sheets

BODY MOUNTED WEAPONS PLATFORM

REFERENCES CITED

| U.S. patents | | |
|---|---|---|
| 6,032,397 | Mar. 7, 2000 | Iannetta |
| 6,556,245 | Apr. 29, 2003 | Holmberg |
| Japanese Patent Publication | | |
| 58022448 | Feb. 14, 1983 | Matsumoto |

DISCUSSION

BACKGROUND OF THE INVENTION

1. Field of the Invention

This invention pertains to an improved platform to which weapons could be mounted, and is specifically directed to a device designed for mounting a firearm and two cameras (for improved targeting) to the forearm.

2. Discussion of Related Art

Military and law enforcement officers use firearms on a daily basis; however there are many concerns with the current method of firearms use. The first concern is that oftentimes conditions are such that visibility or optical reconnaissance is extremely low. During times of smoke, rain, fog, and darkness, visibility is low, and firearms users cannot efficiently find their target.

Another concern is the safety of the user and others. Users can become unsteady, and because there is no safety net for most weapons if the weapons slip out of a user's hands, not only can the weapons fall into the wrong hands, but they could potentially cause harm if misfired. Most firearms are not affixed to anything, and because human nature warrants that an individual could potentially lose their balance or grip, the firearm may cause safety concerns.

Finally, users may need to find their target and aim without the cognizance of the target. Particularly in the instance of the military and law enforcement, oftentimes they cannot afford to stand up, face their target, aim, and shoot. Users do not have a way of targeting without getting into a stance, and because of that, firearms can in turn be inefficient.

Relevant art has attempted to address some (but not all) of these problems, however has not directly addressed all of these concerns. For example, U.S. Pat. No. 6,032,397, issued on Mar. 7, 2000, to Iannetta discloses a comb assembly for a firearm which is designed to reduce rearwards and upwards recoil of a firearm towards the shooter's cheek at the time of firing by mounting a firearm stock on a shoulder firearm with not as much recoil. Iannetta's device, however, does not address any of the concerns relating to limited visibility, target cognizance, and even the safety of the user and others. Although it presents the idea of a mounted firearm, it simply mounts it on another firearm, which could potentially cause the same problems as if it was not mounted on anything.

U.S. Pat. No. 6,556,245, issued on Apr. 29, 2003, to Holmberg, discloses a video camera that can be mounted to a firearm or blow for recording game hunting. The camera has a quick release mount system that allows the video camera to slide on to and off of the weapon with ease. Holmberg's invention, however, does not address the safety concerns associated with firearms that have no safety net. Furthermore, Holmberg's device does not provide a means by which an individual can improve visibility while advancing their targeting abilities.

Furthermore, Japanese Pat. 58022448, issued on Feb. 14, 1983, by Matsumoto discloses a lens on a hand-held that is light and can perform a conversion of a focal distance which can create a snapshot. This lens can then be fit into a gun rack, and installing the rear lens barrel can improve the optical adjustment. Matsumoto's invention, however, magnifies the concern regarding safety because this weapon is rather light, and therefore can easily slip out of the user's hands. Furthermore, Holmberg's invention does not disclose that the lens in any way can aid during times of limited visibility.

It is time for a device for firearms that improves visibility, provides a mode for safe use of firearms, and advances targeting. Although prior art attempts to somewhat solve some of these problems, prior art does not come close to providing a device that quenches all of the concerns regarding firearms and users.

SUMMARY OF THE INVENTION

This invention discloses a Body Mounted Weapons Platform (hereinafter "BMWP"), which is a device that attaches to the right (or left, depending on the user's inclination) forearm, and allows the user to mount within it one or two firearms and two cameras. The device itself is designed such that it provides the user support as he is operating the firearm, while the device stays on the user's arm via a hook-look-type fastener. Furthermore, the cameras are designed such that they provide the user better optical reconnaissance. The BMWP is designed to utilize cameras that have the capability of seeing in light or dark, and through weather conditions such as rain, smoke or fog. Furthermore, they allow individuals who do not trust their eyes (because of vision problems) to have better visibility while operating their firearm. The cameras also provide the user a full field of view with out exposing oneself because of the fact that they will be able to see through the cameras without having to target in the traditional "stand in front of the target" fashion.

DETAILED DESCRIPTION OF THE PREFERRED EMBODIMENTS

Figure 1:
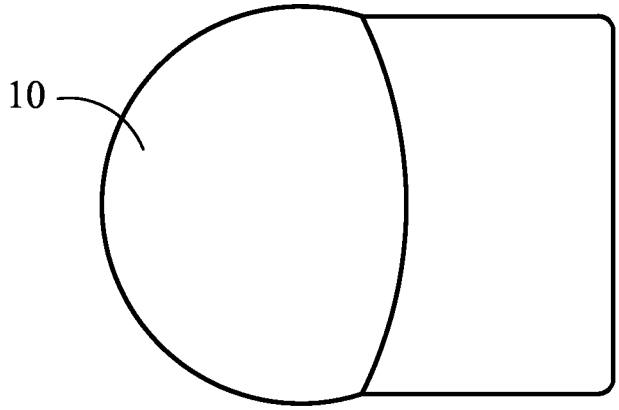
FIG. 1 is a rear view of a first embodiment of the present invention
Figure 17:
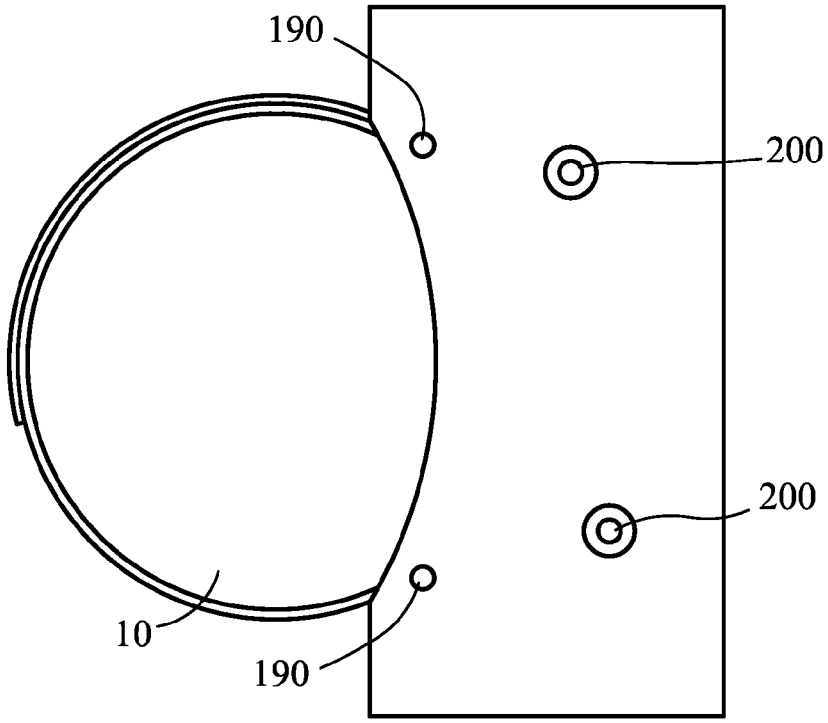
FIG. 17 is a rear view of a second embodiment of the present invention.

As seen in the attached drawings, the present invention is attached to the right forearm using a hook-and-loop-type fastener sleeve (10), or any other material that may be used in furtherance of the principles of this invention. Shown in FIG. 1, the sleeve (10) has a preferred diameter of 4 inches, however may be varied in size depending on the user's preference. The sleeve is held together using two mounting screws (200) (FIG. 17). The present invention is made of industrial firearms grade plastic, having a grade such that it could provide characteristics such as durability and reliability. The user can then mount firearms and cameras, therefore allowing advanced targeting and better optical reconnaissance.

Figure 2:
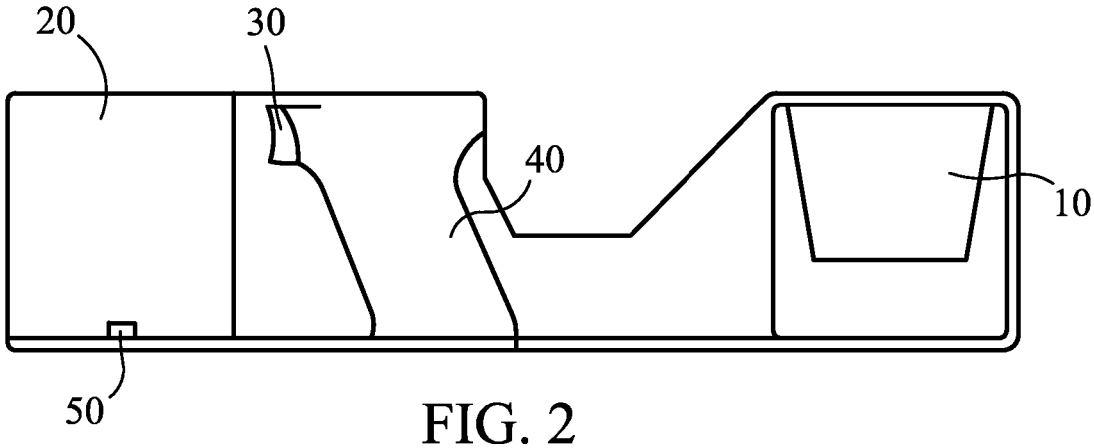
FIG. 2 is a right-side view of a first embodiment of the present invention.
Figure 3:
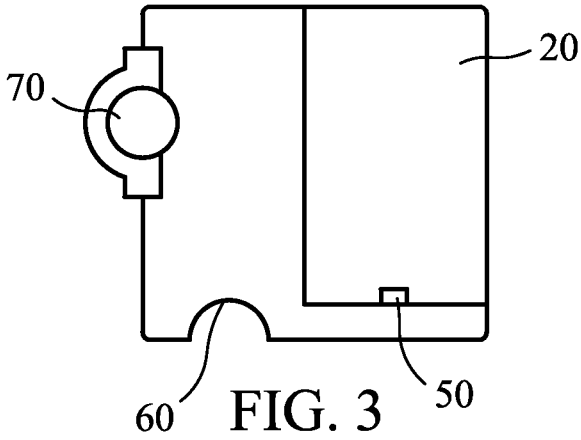
FIG. 3 is a front view of a first embodiment of the present invention.
Figure 4:
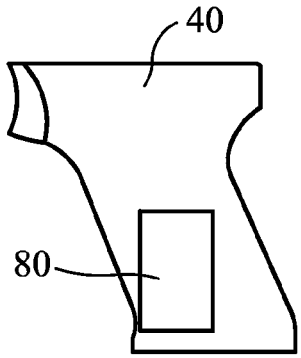
FIG. 4 is a view of the handgrip of a first embodiment of the present invention.
Figure 5:
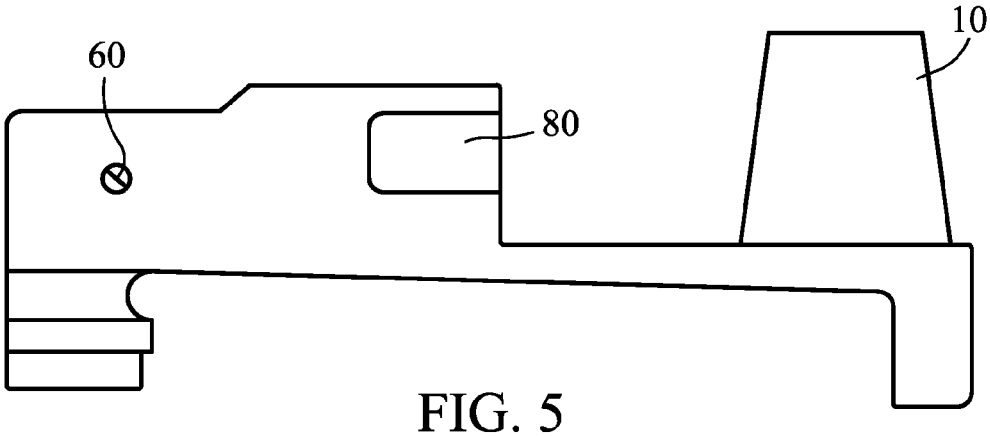
FIG. 5 is a bottom view of the stock of a first embodiment of the present invention.
Figure 6:
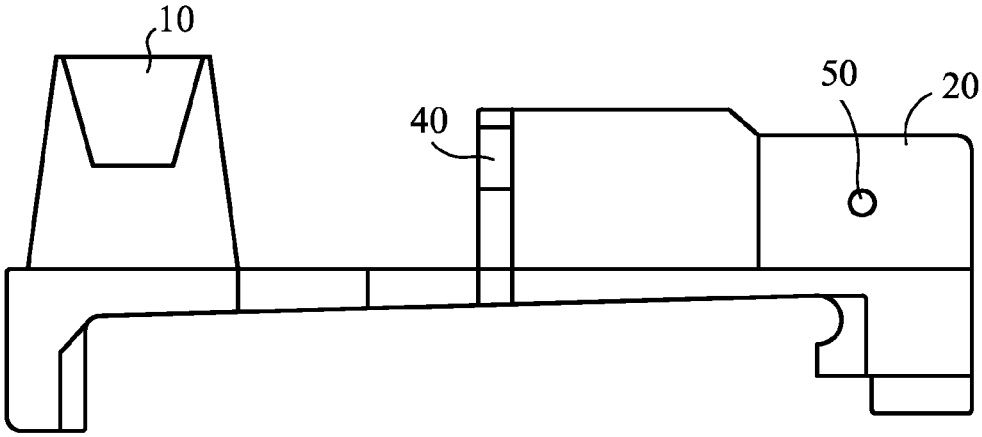
FIG. 6 is a top view looking down on a first embodiment of the present invention.
Figure 7:
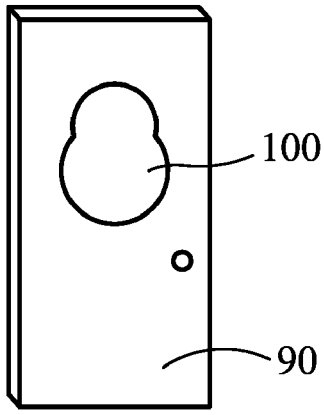
FIG. 7 is a view of a mounting plate for the HKMP5.

The apparatus has two cutouts for cameras. The first 2.5×4- inch or 4×4-inch (depending on the preferred embodiment) cutout (20) is for the main camera, such as one of the many military cameras made by ITT. The second 1.0×2.5-inch halfmoon cutout (30) is designed for a camera such as the Smith and Wesson camera system. Although these two particular types of cameras work well with the present invention, the invention is not limited to solely those cameras, and is designed to use any camera that fulfills the purpose of this invention. Furthermore, with the advent of video imaging and audio capabilities, the cutouts may use cameras that can provide electronic capability for video and audio broadcast. As shown in FIG. 3, the two cutouts that hold their respective cameras are in-line, which allows for optimal targeting capabilities. While the second halfmoon cutout (30) can be positioned at a different place on the platform, the second camera cutout (30) should be positioned such that it can view the same target. The present invention will operate on a 9V battery (80), (FIG. 4) however may require less energy as further innovation may discover. The cameras will be installed based on the requirements of the camera manufacturers, one possibility being that the camera is held by a mounting screw (50), as shown in FIG. 2.

Figure 8:
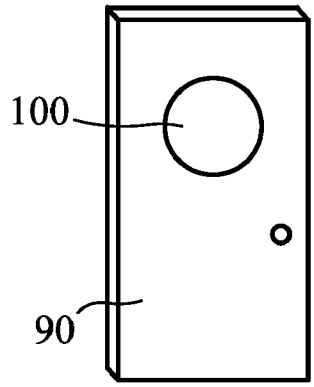
FIG. 8 is a view of a mounting plate for the M16 recoil buffer.
Figure 9:
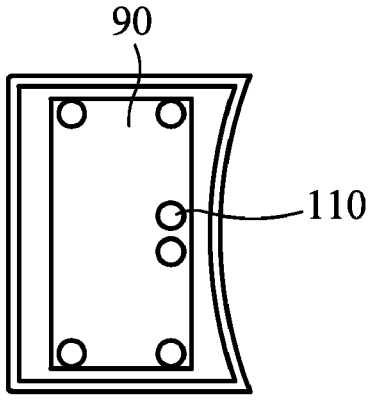
FIG. 9 is the inside rear view of the stock of a first embodiment of the present invention.
Figure 10:
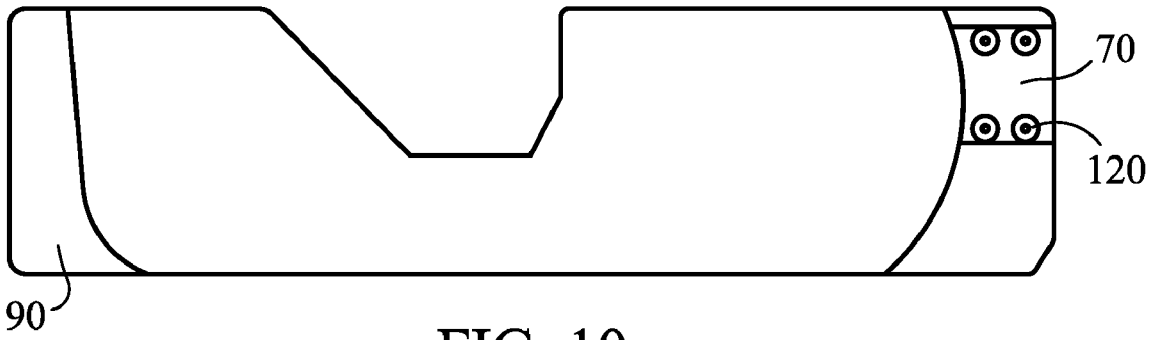
FIG. 10 is a left-side view of a first embodiment of the present invention.

The present invention can hold either one or two weapons, depending on the embodiment the user prefers. Mounting plates (90) are first permanently affixed to the firearm by placing the firearm's recoil buffer into a hole (100) specifically designed for that specific firearm. For example, a hole (100) for an M16 will be 1-inch, which is the size of its recoil buffer. (FIG. 8). Mounting plates (90), as in FIG. 9, will generally be 3.5×1.75-inches, however may be larger or smaller so long as its size is in furtherance of the principles of this invention. The firearms-mounting plates are then inserted in the rear of the stock, and are bolted down using screws (120) in order to hold down the barrel (70), as shown in FIG. 10. Allen screws (120) are preferred; however any screws common in the art may be used in order to efficiently hold down the barrel. Once the firearm is sufficiently in place, the user may use the handgrip (40) and trigger (30) to aim and shoot at your target.

The following are embodiments of the invention that employ the use of either one or two firearms. While still presenting the same features that make them novel and non-obvious, they can be used for different functions while still presenting the same desired results.

1. Body Mounted Weapons Platform-One Firearm

Figure 11:
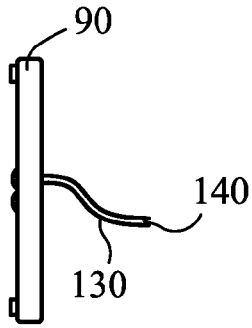
FIG. 11 is a side view of the rear insert-mounting bracket of a first embodiment of the present invention.

The first embodiment allows the user to mount within it one firearm, and the firearm can be removed and replaced with different firearms for different operations, depending on the requirements of the user. The firearm may be inserted as directed above, and requires bolting of 4 screws (120) to hold down the barrel (70), as shown in FIG. 10. The mounting plate (90) for each firearm can enter the stock. The mounting plate (90) holds the apparatus in alignment, in order to keep the device tight on the user's arm so that it is not falling off. Furthermore, the mounting plate (90) should be able to easily slip in and out in order to replace the weapons mounted in the platform. At the rear of the mounting plate (90) is wiring (130) that goes through the bracket and splits into two electrical connections (140), finally connecting inside the stock (110), as shown in FIG. 11. This powers the firearm, in conjunction with the 9V battery (80), such that the solenoid is powered, allowing the weapon to be fired.

2. Body Mounted Weapons Platform-Two Firearms

Figure 12:
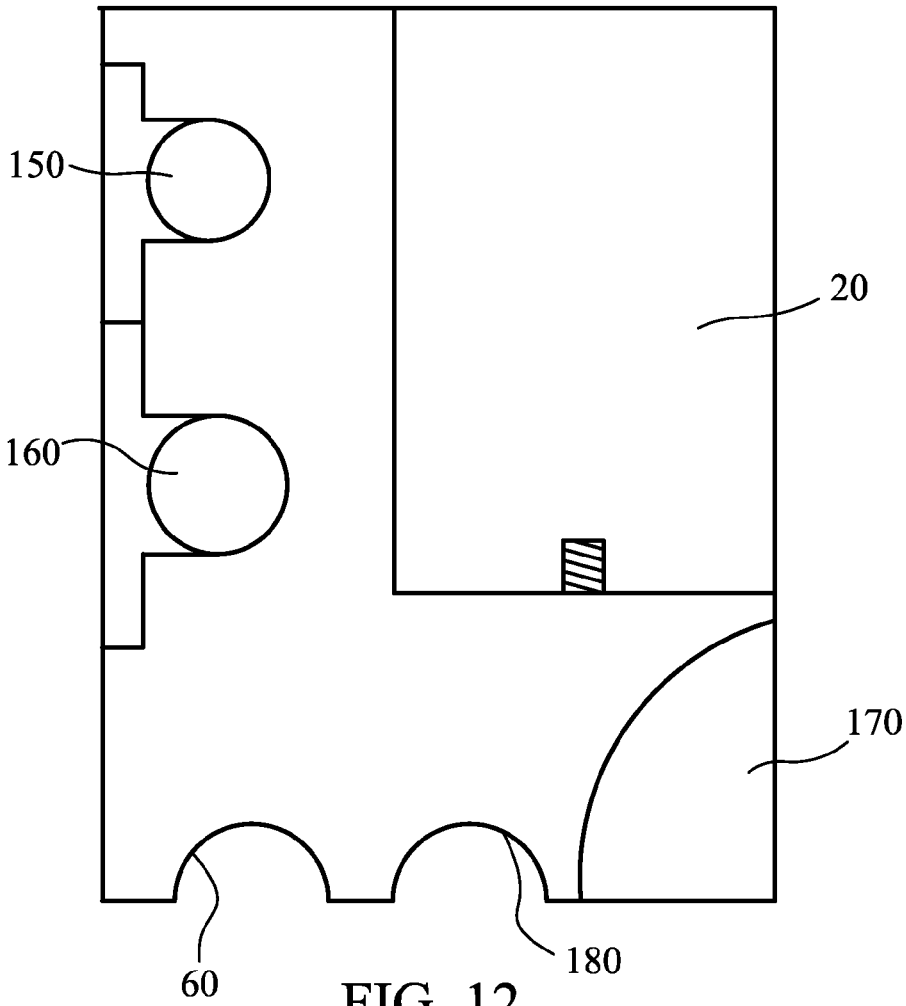
FIG. 12 is a front view of a second embodiment of the present invention.

The second embodiment incorporates both lethal (150) and non-lethal (160) firearms. In addition to the two camera cutouts described earlier, this model contains cutouts for the installation of lights (170) and tazers (180). The tazers (180), cutout for lethal (150), and nonlethal (160) weapons allow the user many options for dealing with any combat situation (FIG. 12). The cutout for the installation of a flashlight is preferred as a 4×4-inch cutout. The cutout for the lights (170) serves to allow optimal recognizance in the dark, or through bad weather. The cutout for the tazer is preferred as a half circle cutout with a 1-inch diameter. There are two cutouts for the placement of firearms into the SE18L: The top cutout (150) is a circular cutout with a 785/1000th -inch diameter, and is designed for a lethal weapon, such as a 44-caliber automatic weapon or any other lethal weapon based on the requirements of the user. The bottom cutout (160) is a circular cutout with a 875/1 000th-inch diameter, and is designed for a non-lethal weapon, such as a 12-guage automatic shotgun or any other non-lethal weapon based on the requirement of the user.

Figure 13:
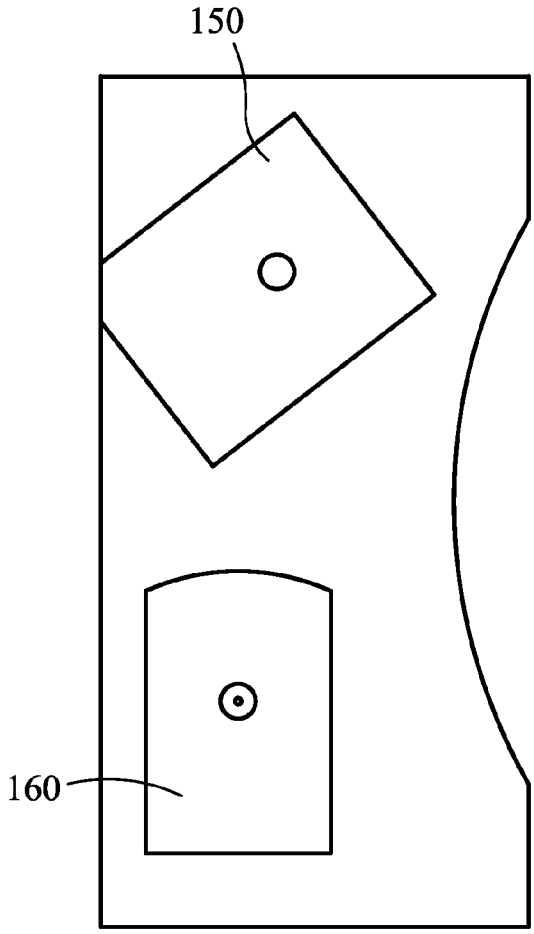
FIG. 13 is a rear inside view of the two firearm cutouts of a second embodiment of the present invention.
Figure 14:
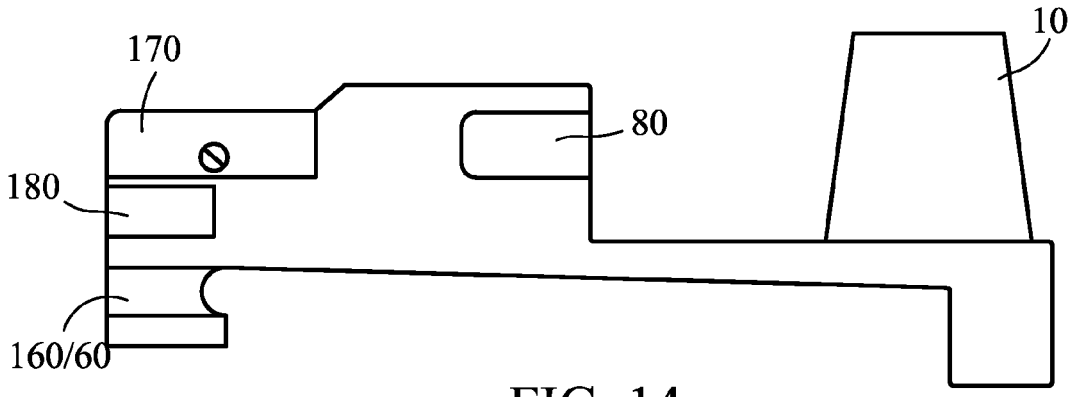
FIG. 14 is a bottom view of a second embodiment of the present invention.
Figure 15:
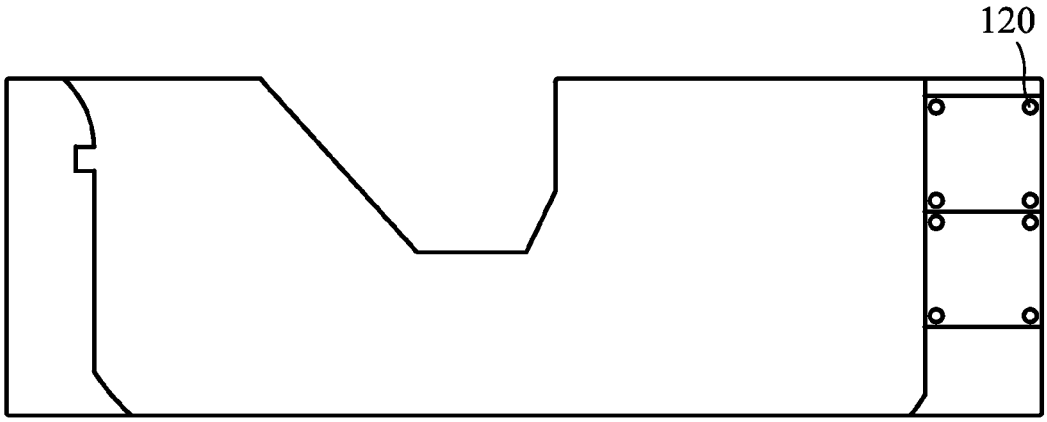
FIG. 15 is a left-side view of a second embodiment of the present invention.
Figure 16:
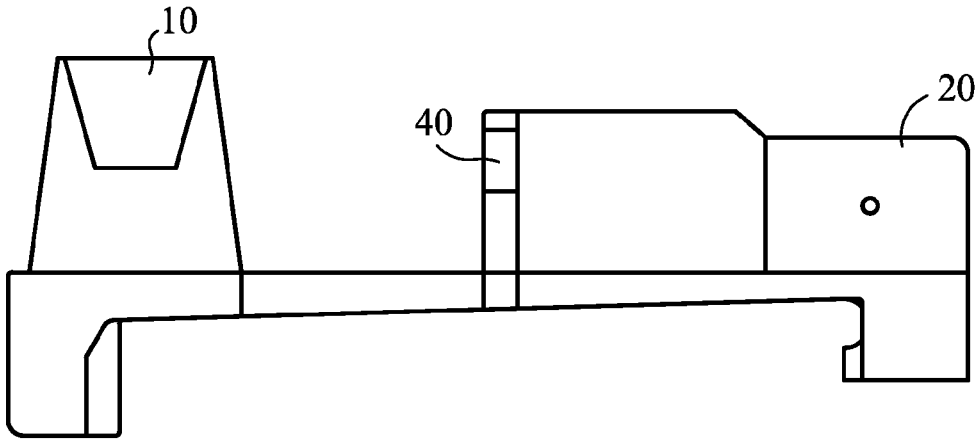
FIG. 16 is a top view of a second embodiment of the present invention.
Figure 18:
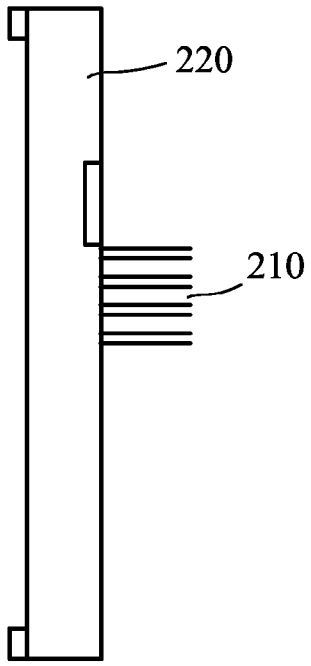
FIG. 18 is a side view of the interchangeable butt plate of a second embodiment of the present invention.
Figure 19:
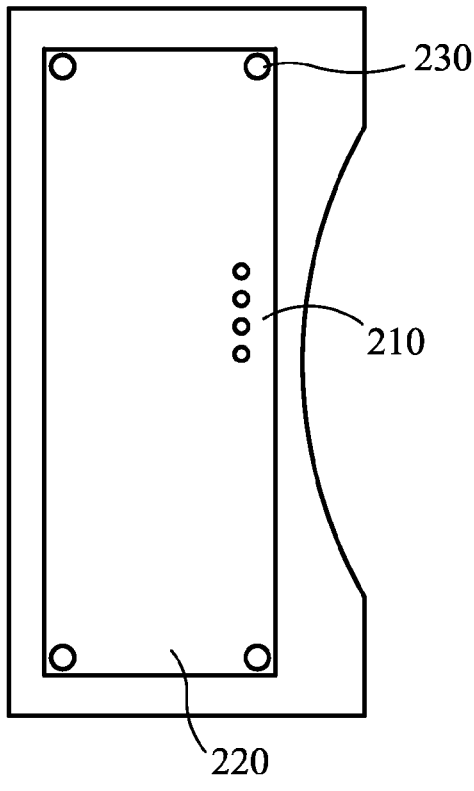
FIG. 19 is an option rear inside view of the stock of a second embodiment of this invention.
Figure 20:
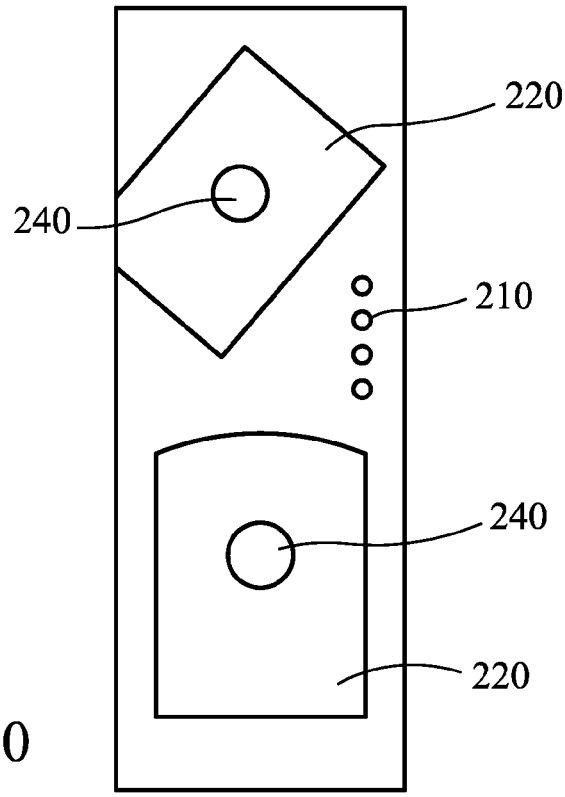
FIG. 20 is the front view of the interchangeable butt plate insert of a second embodiment of this invention.

The firearms in this particular embodiment cannot be removed or replaced, and the barrels are bolted to the front two mounting plates that lock down over the barrels. The mounting plate for the non-lethal firearm is 2×2-inches and the mounting plate for the lethal firearm is 2×2-inches. For assembly purposes, the lethal weapon (150) is canted at a 45-degree angle, allowing it to feed and eject easily, as shown in FIG. 13. The firearm receivers are then held in place by two rear lug bolts (200), as shown in FIG. 17. For faster assembly and disassembly, an interchangeable insert (220), as shown in FIG. 19, may be placed into the stock. An interchangeable butt plate (220) may be slipped into the stock using an interior hole (240), without using two lugs (200). There are then four electrical connections (210) inside the stock for the solenoid wires going through the butt plates, as shown in FIG. 18.

Figure 21:
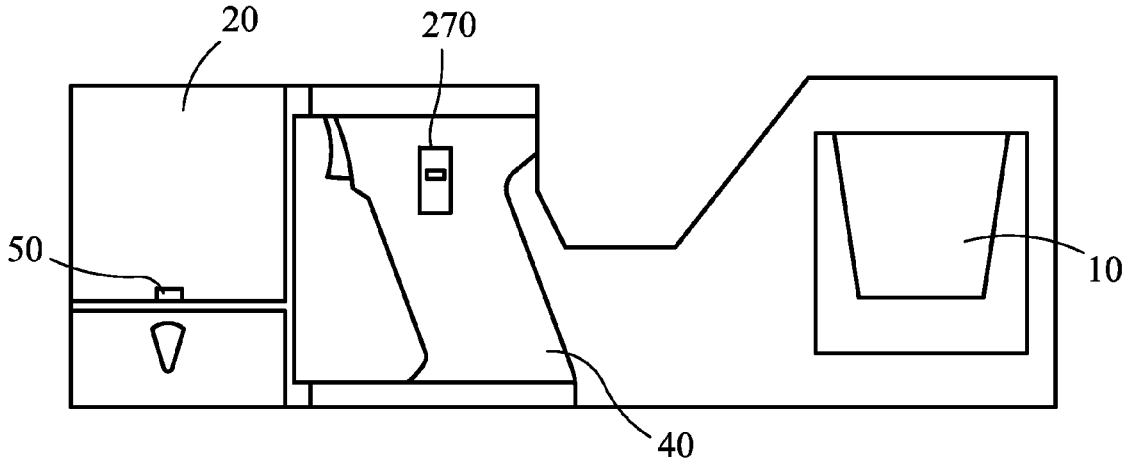
FIG. 21 is a right-side view of a second embodiment of this invention.
Figure 22:
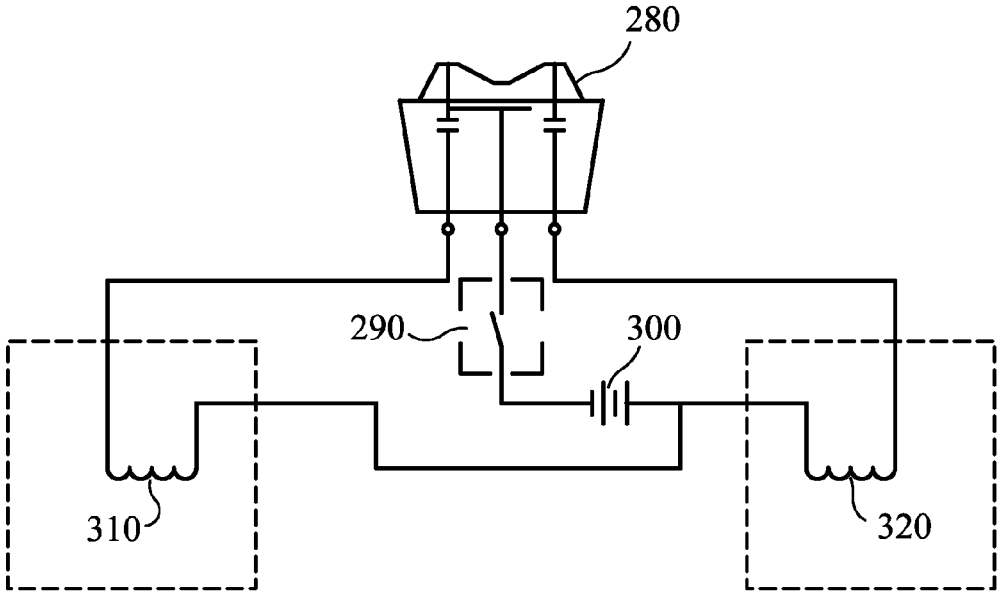
FIG. 22 is a front view of the momentary rocker trigger.

This embodiment also contains a solenoid selector switch (270) which is located on the side of the handgrip, as shown in FIG. 21. The selector switch (270) determines which weapon is to be fired, allowing the user discretion as to whether to use lethal or non-lethal force. Shown in FIG. 22 the momentary rocker (280) is a two position, normally open switch that allows power from the Battery (300) through a latching safety thumb switch/(solenoid selector switch) (290) to the firing solenoid (310 or 320) that is mounted to the real firearm's firing trigger device. When pressed to either the upper or lower position, the appropriate solenoid is energized and mechanically depresses the real firearm's firing trigger, discharging the weapon. Both embodiments provide discretion to what methods to employ when using firearms and provide superior response to the concerns such as low visibility, safety, and targeting.

I claim:

1. An apparatus for improving targeting and optimal recognizance, comprising:

a body attaching member;

a base member in communication with said body attaching member, said base member having a rear end;

at least one firearm receiving section on said base member;

at least one camera receiving section on said base member;

a battery in communication with said firearm-receiving section;

a solenoid switch in communication with said at least one firearm receiving section; and a selector switch in communication with said at least one firearm receiving section.

2. The apparatus of claim 1, wherein a mounting bracket is inserted into a rear end of said base member.

3. An apparatus for improving targeting and optimal recognizance comprising:

a body attaching member;

a base member in communication with said body attaching member;

at least one lethal firearm receiving section on said base member;

at least one non-lethal firearm receiving section on said base member;

at least one camera receiving section on said base member;

a flashlight receiving section on said base member;

a tazer receiving section on said base member;

a solenoid switch in communication with said lethal firearm receiving section and said non-lethal firearm receiving section; and a selector switch in communication with said lethal firearm receiving section and said non-lethal firearm receiving section.

4. The apparatus of claim 3, further comprising a battery in communication with said firearm receiving section.

5. The apparatus of claim 3, wherein said body attaching member is a sleeve.

6. The apparatus of claim 3, wherein said body attaching member can receive a user's arm.

7. The apparatus of claim 3, wherein said body attaching member is made of a hook-and-loop-type fastener.

8. The apparatus of claim 3, wherein a mounting plate is affixed to said firearm receiving section.

9. The apparatus of claim 3, wherein a mounting bracket is inserted into said rear end of said base member.

10. The apparatus of claim 3, wherein said selector switch determines whether a lethal firearm in communication with said at least one lethal firearm receiving section or a non-lethal firearm in communication with said at least one non-lethal firearm receiving section will be fired.

11. The apparatus of claim 3, wherein an interchangeable butt plate is inserted into said rear end of said base member.

* * * * *